United States Patent [19]

Coulborn et al.

[11] Patent Number: 4,875,417

[45] Date of Patent: Oct. 24, 1989

[54] END STRUCTURE FOR RAILWAY CAR

[75] Inventors: John W. Coulborn, St. Louis County; John A. Krug, St. Charles County, both of Mo.

[73] Assignee: ACF Industries, Incorporated, Earth City, Mo.

[21] Appl. No.: 87,781

[22] Filed: Aug. 21, 1987

Related U.S. Application Data

[63] Continuation-in-part of Ser. No. 792,215, Oct. 28, 1985, Pat. No. 4,696,238.

[51] Int. Cl.[4] ..... B61D 7/00; B61D 17/00

[52] U.S. Cl. ..... 105/248; 105/404; 105/413; 105/420

[58] Field of Search ..... 105/247, 248, 396, 404, 105/409, 411, 413, 414, 418, 420; 219/137 R, 162

[56] References Cited

U.S. PATENT DOCUMENTS

| | | | |
|---|---|---|---|
| 891,297 | 6/1908 | Shallenberger | 105/420 |
| 1,144,378 | 6/1915 | Posson | 105/411 |
| 1,547,639 | 7/1925 | Campbell . | |
| 1,933,772 | 11/1933 | Stresau | 219/137 R X |
| 2,286,954 | 6/1942 | Clarke et al. | 105/418 |
| 3,040,679 | 6/1962 | Warntz | 105/248 |
| 3,102,498 | 9/1963 | Dean | 105/409 X |
| 3,577,933 | 5/1971 | Ferris | 105/416 X |
| 3,605,634 | 9/1971 | Johnson | 105/418 X |
| 4,563,957 | 1/1986 | Billingsley et al. | 105/413 X |
| 4,646,653 | 3/1987 | Balbi et al. | 105/409 X |
| 4,696,238 | 9/1987 | Billingsley et al. | 105/248 |

*Primary Examiner*—Stephen M. Hepperle

*Attorney, Agent, or Firm*—Polster, Polster and Lucchesi

[57] ABSTRACT

An end structure for a railway car, and more particularly a covered hopper railway car, is disclosed which has side sill extensions extending diagonally inwardly from the ends of the side sills to the center stub sill for transmitting substantially all of the longitudinal, horizontal loads between the center stub sill and the side sills. A generally vertically extending truss is provided between the center stub sill and the end of the car above the center stub sill so as to withstand overturning moments and vertical loads between the end of the car and the center stub sill. A connector casting rigidly interconnects the side sills and the side sill extensions. A transition plate is in face-to-face engagement with the side sheets at the outer ends of the side sills so as to facilitate the transfer of load between the side sills and the side sheets. A cutout is provided in the bottom of the side sills at the ends thereof so as to enable interior welds to be made. A high strength steel cover plate closes the output. The connector casting has an integral roping staple.

5 Claims, 11 Drawing Sheets

107
103
105

107
103
105

103
69b'
107
105

21
21
101
115

123b
117
119
121b
22
22
19
19
18
119
117
115
121b
121a 18
119
123b
123a
115
117

END STRUCTURE FOR RAILWAY CAR

CROSS-REFERENCE TO A RELATED APPLICATION

This is a continuation-in-part application of U.S. patent application Ser. No. 792,215, filed Oct. 28, 1985, now U.S. Pat. No. 4,696,238.

BACKGROUND OF THE INVENTION

This invention relates to a stub center sill-type of railway car, such as a covered hopper car or the like. Such stub sill cars have, in the past, utilized a center stub sill assembly so as to securely mount the coupler to the car. These cars had side sills which ran lengthwise of the car at the lower, outer sides of the car. These side sills carried tension and compression lengthwise of the car. A horizontal shear plate was secured to the center stub sill assembly above the level of the coupler, and this shear plate extended laterally of the car and was secured to the end portions of the side sills so as to transversely transmit loads from the center stub sill to the side sills. The shear plate was reinforced by an end sill extending vertically from the outer transverse edge of the shear plate and by an upper bolster web secured to the inner transverse edge of the shear plate such that the shear plate, the end sill, and the upper bolster web formed a horizontally disposed generally channel-shaped weldment so as to transfer loads from the center stub sill to the side sills. Such a construction is shown in FIG. 12. Because the shear plate was located above the longitudinal axis of the coupler, and since the coupler was capable of transmitting very high forces from the coupler to the center sill and thence to the side sills, this construction induced considerable eccentric loading, which in turn applied considerable moments to the end structure of the car. To counteract these eccentric loads and moments, additional structure, such as diagonal stiffeners, and upper bolster web stiffeners were welded to the shear plate.

Reference may be made to the prior co-assigned U.S. Pat Nos. 3,339,499 and 3,490,387 which disclose prior art covered hopper cars having end frame constructions generally as above-defined. In the railway car disclosed in the above-noted U.S. Pat. No. 3,339,499, the end structure employed diagonal end struts or gussets which were secured along their inner edges to the inclined end slope sheets of the car and to the upper bolster web so as to form a rigid structure for reacting moments. The moments generated from impact or squeeze forces and draft loads acting on the car were reacted by a statically indeterminate structure formed by the upper end bulk head, upper bolster web, end slope sheet, and diagonal struts or braces which formed the prior art end frame structures. In this statically indeterminate structure, it was difficult to ascertain load paths and it was suspected that extra material and excess weight was required to carry the loads.

In the prior co-assigned U.S. Pat. No. 3,490,387, an end structure for the car was provided in which the forces carried by each of the members could be more readily determined such that more efficient use of the materials utilized to construct the end structure of the car could be attained. However, the car end frame construction utilized in the prior U.S. Pat. No. 3,490,387 still utilized a transverse shear plate, diagonal braces, and other members to connect the center sill to the side stub sills and to react moments, as generally shown in FIG. 12 herein.

The co-assigned U.S. Pat. No. 4,168,665 also discloses a center stub sill covered hopper car construction in which a corrugated bolster web is provided such that the corrugations served to reinforce the bolster web.

U.S. Pat. No. 1,547,639 to Campbell discloses a triangular shaped shear plate for transferring longitudinal loads between the side sills and the center stub sill. It will be appreciated that while Campbell did utilize diagonal members extending between the ends of the side sills and the center stub sill, these diagonal members did not constitute the only horizontal load path between the center stub sill and the side sills, but the triangular shear plate was also rigidly tied to the side sill ends and the stub sill and was active in transmitting longitudinal loads therebetween.

Lastly, Kiesel, U.S. Pat. No. 2,092,457 discloses a center through sill car (as opposed to a stub sill car) which has a cast truss at the end of the car. However, in contrast with the invention herein (and the invention of the parent application), the truss of Kiesel is not for the purpose of reacting overturning moments between the stub sill and the side sills (since Kiesel does not have either a stub sill or side sills), but rather for supporting the end of the car against lading loads.

SUMMARY OF THE INVENTION

Among the several objects and features of the present invention may be noted the provision of a center stub sill-type railway car which employs an end structure so as to eliminate the necessity of the shear plate so as to transfer longitudinal loads between the center stub sill and the side sills, which in turn results in substantial weight and cost savings;

The provision of such a railway car end structure which is easier to fabricate than prior art cars utilizing a shear plate end structure in that considerable welding is eliminated;

The provision of such an end structure which facilitates repair and lowers the cost of repair of the end structure (if such repair becomes necessary);

The provision of such an end structure which eliminates the necessity of a separate body bolster upper cover plate and a separate horizontal web plate for the center stub sill assembly;

The provision of such an end structure in which loads are efficiently transferred between the side sheets and the ends of the side sills while minimizing the thickness of the side sheets and reducing the tendency of the side sheet to buckle;

The provision of such an end structure in which a rigid casting interconnects the ends of the side sills and the diagonal side sill extensions and in which this casting incorporates an integral roping staple so as to allow a towing hook, in accordance with Association of American Railroads (AAR) requirements, to be hooked to the car so it may be pulled along the track;

The provision of such an end structure in which a cutout is provided in the lower portion of the side sills at the ends thereof so as to facilitate welding of the end structure to the ends of the side sills and to the car body with this opening being covered by a high strength cover plate which is welded in place after certain internal welds have been made; and The provision of such an end structure which is efficient in transmitting loads between the center stub sill and the side sills, and which is of rugged and economical construction.

Other objects and features of this invention will be in part apparent and in part pointed out hereinafter.

Briefly stated, a center stub sill railway car is disclosed having a center stub sill at each of the car carrying a coupler and a pair of spaced side sills generally at the level of the center stub sills and extending longitudinally of the car. Means is provided at each end of the car, extending diagonally between the end portions of the side sills and a respective center stub sill for transmitting longitudinal loads between the center stub sill and the side sills. The car includes a car body having side sheets. These means include so-called side sill diagonal members which are secured to the ends of the side sills. A plate in face-to-face engagement with the side sheets locally reinforces the side sheets adjacent the ends of the side sills so as to facilitate the transfer of loads between the end structure and the ends of the side sills while reducing the tendency of the side sheets to buckle.

In another embodiment, this invention relates to an end structure for a center stub sill railway car in which the end structure includes a rigid integral casting for, interconnecting the side sills, the side sill diagonal members and a tension/compression strut extending transversely between the ends of the side sills. This casting includes a roping staple or eye therein such that a towing cable may, in accordance with AAR requirements, be hooked to the car for pulling the car along the track. This connector casting thus serves the double function as an efficient connector between the respective end structure members and as a table eye thereby to permit pulling of the car.

In still another embodiment of the end structure of the present invention, each of the side sills has a cutout in the bottom thereof at each end of the side sill. This cutout facilitates the internal welding of the side sills to their respective connector castings on the inside thereof. After these inside welds have been made, a cover plate of high strength steel is welded in plack to the side sill and the connector casting thereby to both close the opening and to effciently carry locally high stress levels in the bottom of the side sills at the ends thereof.

BRIEF DESCRIPTION OF THE DRAWINGS

Corresponding reference characters indicate corresponding parts throughout the several view of the drawings.

DESCRIPTION OF A PREFERRED EMBODIMENT

Figure 1:
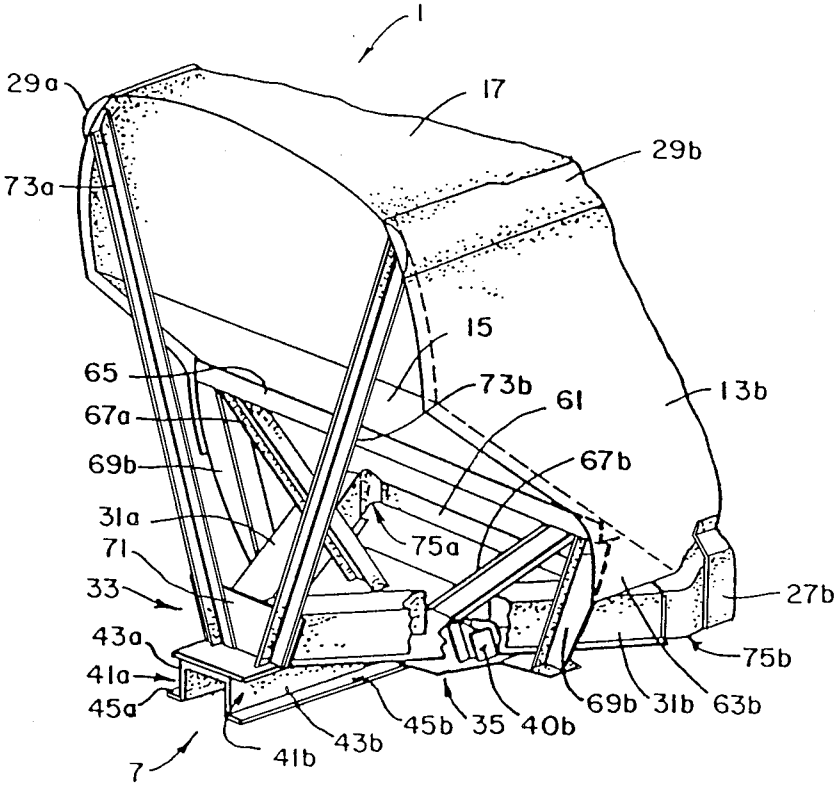
FIG. 1 is a three-quarter perspective view of one end of a railway covered hopper car of the present invention, having a center stub sill and an end structure in accordance with the present invention.

Referring now to the drawings, a railroad car, and more particularly, a center stub sill covered hopper car, is shown in its entirety by reference character 1. The railroad car includes a car body 3 having an end structure 5 of the present invention at either end of the car body. Only one such end structure 5 is shown since the end structure is identical at each end of the car.

Figures 2, 12:
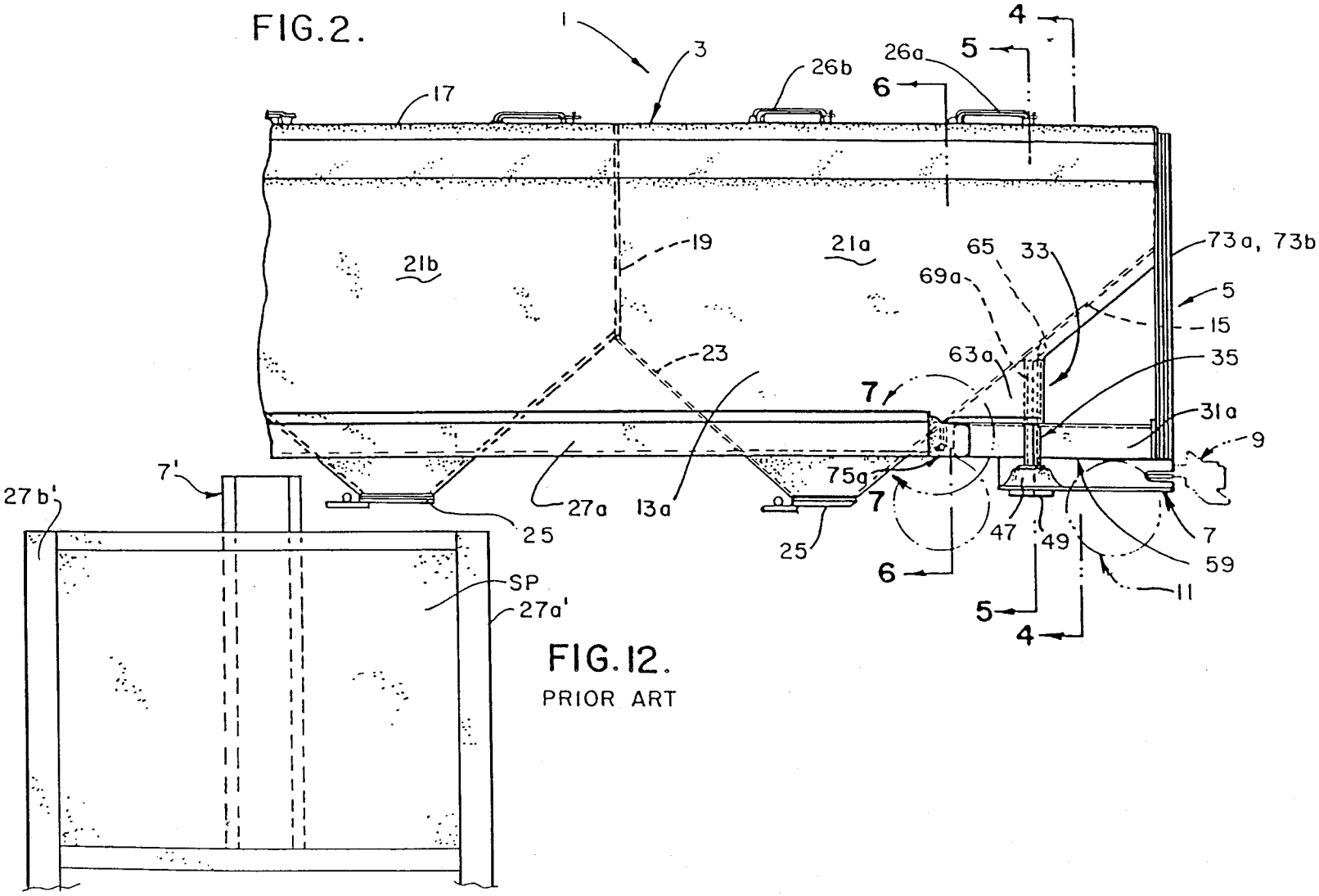
FIG. 12. PRIOR ART
FIG. 2 is a side elevational view of a railroad car with the truck assembly shown in phantom.
FIG. 12 (sheet 2) is a view similar to FIG. 11 of a conventional shear plate center stub sill railway car.
Figure 5:
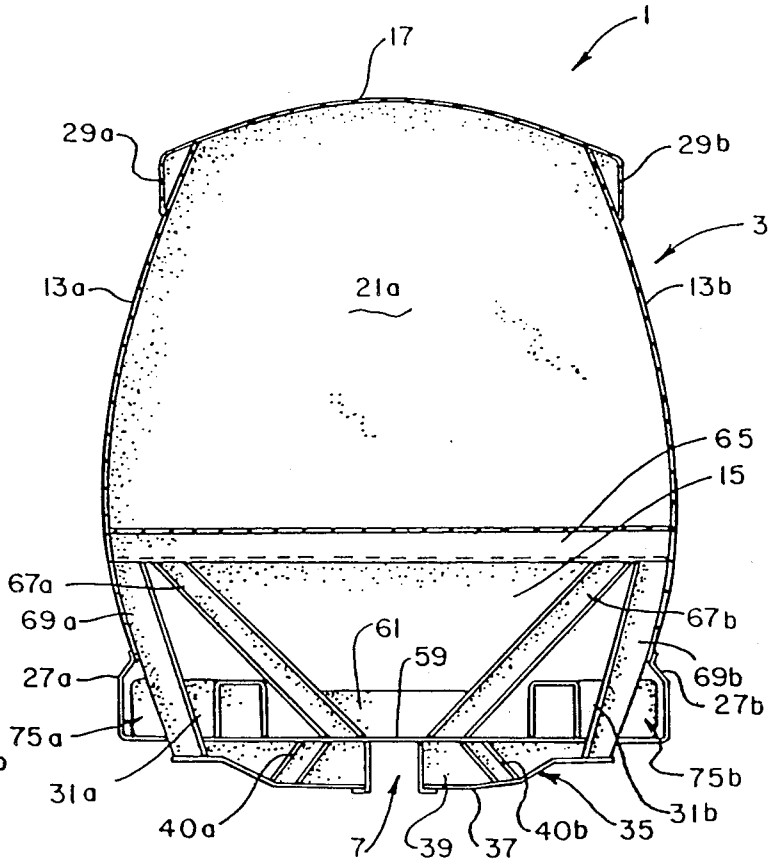
FIG. 5 is a cross sectional view of the car, taken along line 5—5 of FIG. 2.
Figure 4:
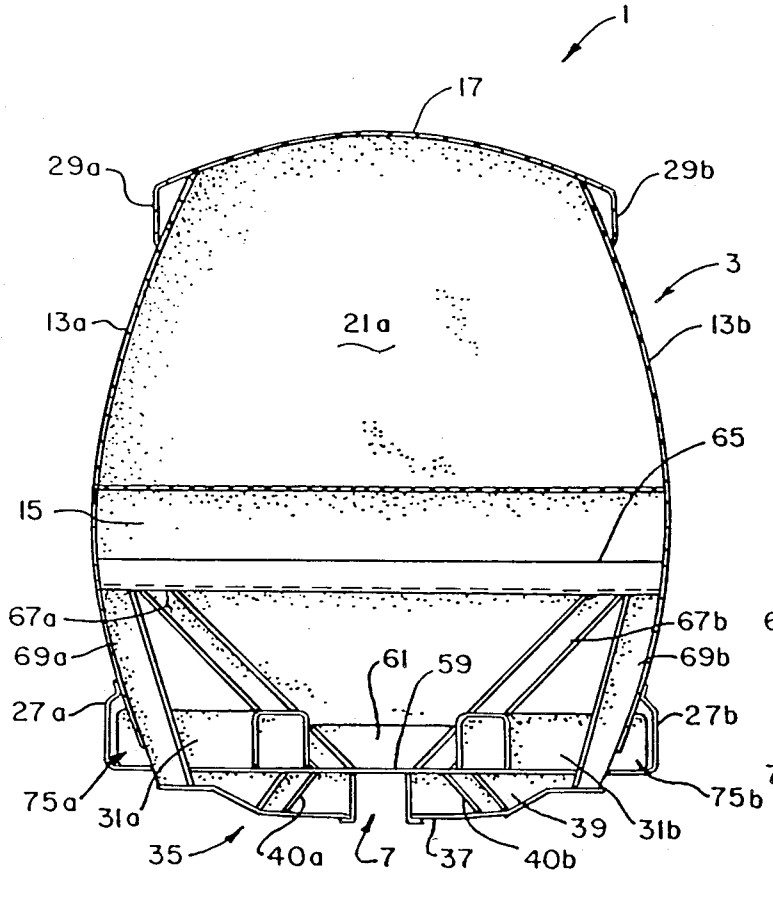
FIG. 4 is a vertical cross sectional view of the car, taken along line 4—4 of FIG. 2.

More specifically, end structure 5 of the present invention includes a center stub sill assembly, as generally indicated at 7, to which a coupler 9 (see FIG. 2) is attached. The coupler 9 transfers longitudinal train loads, including tension or draft loads, compression or squeeze loads, and impact loads to the center stub sill assembly. Coupler 9 also transfers certain vertical and lateral loads to the center stub sill assembly. Railroad car 1 rides on a pair of truck assemblies 11, one at each end of the car. The truck assemblies, as shown in phantom in FIG. 2, are oonventional and only parts of the truck assembly, as they apply to the end structure 5 of the present invention, will be described in detail.

Car body 3 includes side sheets 13*a*, 13*b* forming the sides of the hopper car, with an end floor or slope sheet 15 at either end of the side sheets. A roof 17 is attached to the upper ends of the side sheets and to the upper ends of the end slope sheets so that the car body is totally enclosed. Partition and slope sheets 19 (see FIG. 2) divide the interior of the car body into a plurality of hoppers, as indicated at 21*a*–21*d*, extending lengthwise of the car. Each of these hoppers has intermediate floor sheets 23, which lead downwardly to a hopper outlet, as generally indicated at 25. The specific structure of hopper outlet will not be described in detail inasmuch as the hopper outlet does not, per se, relate to the present invention. Hoppers 21*a*–21*d* may be loaded via hatch covers 26*a*–26*d* in the conventional manner.

Figure 9:
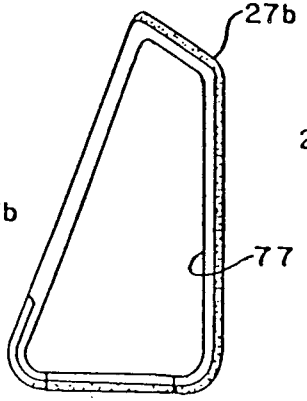
FIG. 9 is a cross sectional view of the side sill and of the casting, taken along line 9—9 of FIG. 7.
Figure 6:
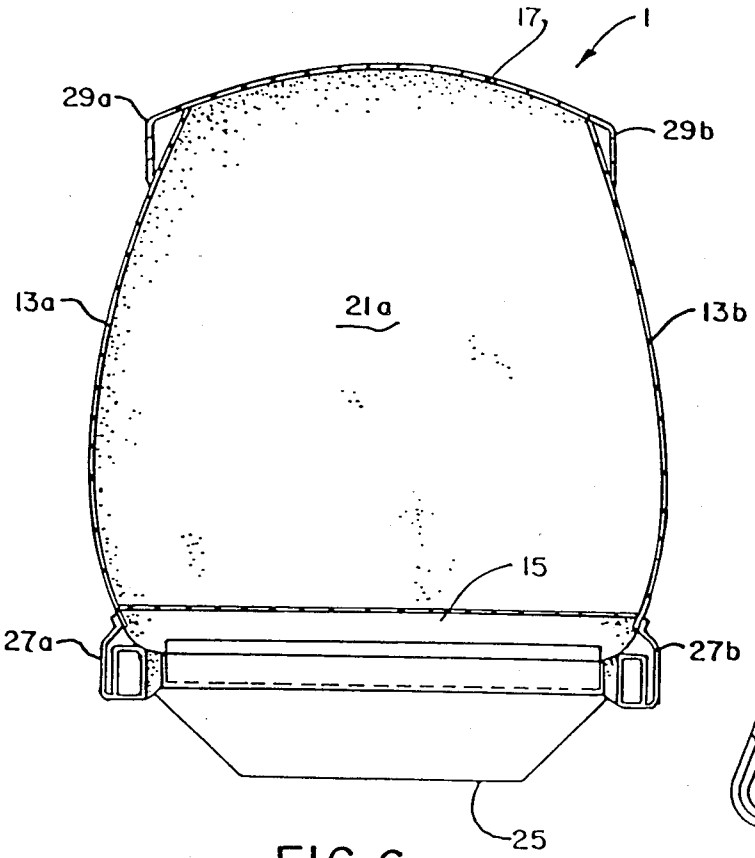
FIG. 6 is a vertical cross sectional view of the car, taken along line 6—6 of FIG. 2.
Figure 10:
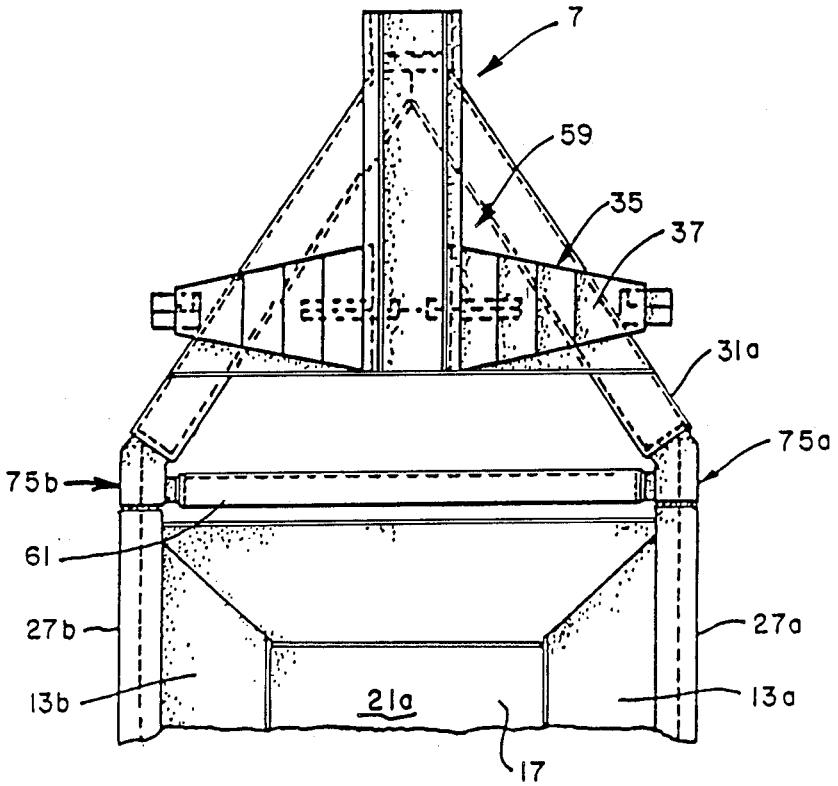
FIG. 10 is a bottom plan view of the end structure of the present invention.

Further, car body 3 includes a pair of side sills 27*a*, 27*b* securely attached (welded) to the lower marginal portions of respective side sheets 13*a*, 13*b*, with the side sills 27*a*, 27*b* extending substantially the entire length of the side sheets. Side sills 27*a*, 27*b* transfer longitudinal loads the length of the car generally proximate the lower portions of the side sheets 13*a*, 13*b*. As generally shown in FIG. 9, each side sill 27*a*, 27*b* is a box beam of generally trapezoidal cross section. The upper portions of side sheets 13*a*, 13*b* are reinforced by side plates 29*a*, 29*b*, respectively, attached to the upper portions of each of the side sheets for reinforcing the side sheets against buckling under compressive and other loading conditions.

In accordance with the present invention, end structure 5 of the present invention joins the ends of the side sills 27*a*, 27*b* to the center stub sill assembly 7 at each end of the car so as to effectively transmit train loads from coupler 9 and center stub sill assembly 7 to the side sills, these train loads including tension (or draft) loads, compression (or squeeze) loads, and impact loads. Additionally, end structure 5 of the present invention includes truss means 33 (as will be hereinafter described in detail) for effectively withstanding and reacting moments induced by the lading within car body 3 as applied to the ends of the car body, and overturning moments induced in the end structure 3 caused by the vertical offset of center stub sill 7 and side sills 27*a*, 27*b*.

More specifically, in accordance with this invention, side sills 27*a*, 27*b* each have respective diagonal side sill extensions or end portions 31*a*, 31*b* which are rigidly secured (e.g., welded) to the ends of their respective side sills in a manner as will appear. The sill extensions 31*a*, 31*b* are box beams which extend diagonally from the ends of the side sills toward the longitudinal centerline of the car. As best shown in FIG. 2, the sill extensions 31*a*, 31*b* and the side sills 27*a*, 27*b* are spaced somewhat above the axis of the center stub sill assembly 7 and coupler 9.

A body bolster, as generally indicated at 35, is rigidly secured to the bottom of sill extensions 31*a*, 31*b*, to center stub sill 7, and to truss means 33 so as to support one end of the car body 3 on truck 11. Body bolster 35 includes a lower cover plate 37 and a vertically disposed body bolster web 39 extending upwardly from lower cover plate 37. Web gusset members 40*a*, 40*b* stiffen bolster web 39. As shown best in FIG. 1, center stub sill assembly 7 includes a pair of spaced angle members, as generally indicated at 41*a*, 41*b*, which are secured (e.g., welded) to body bolster 35. Angle members 41*a*, 41*b* are spaced apart from one another and each has a respective vertical flange 43*a*, 43*b* (as best shown in FIG. 1) spaced apart from one another a distance so as to receive a coupler 9 in the conventional manner. Additionally, angle members 41*a*, 41*b* each include respective outwardly extending legs 45*a*, 45*b*.

Figure 3:
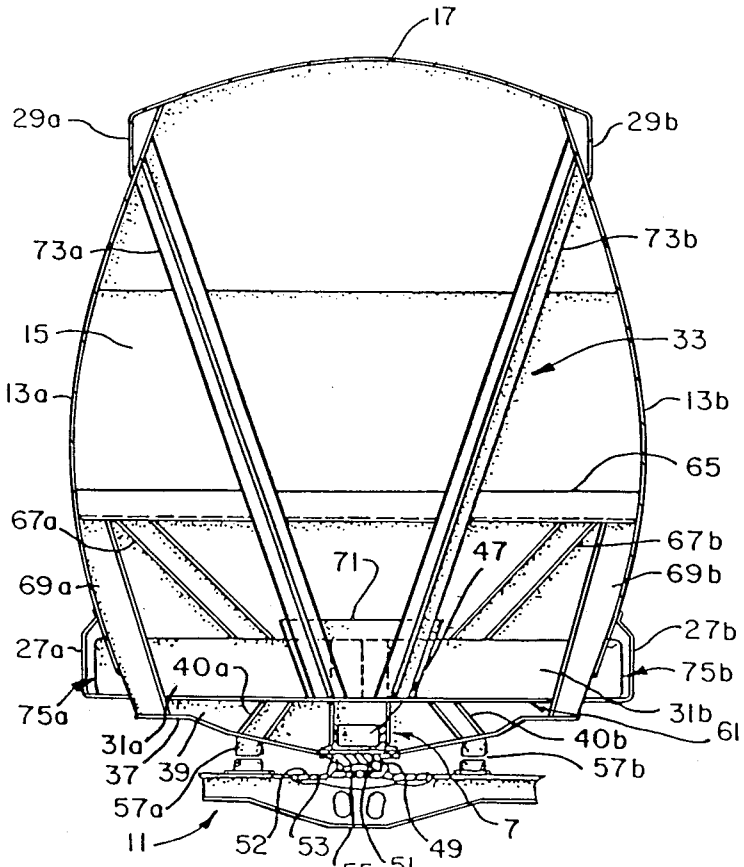
FIG. 3 is an end elevational view of the railroad car shown in FIG. 2.

Installed between and welded to vertical spaced flanges 43*a*, 43*b* of angle members 41*a*, 41*b* constituting the center stub sill assembly 7, a so-called center plate 47 is secured (see FIG. 3). The center plate has a downwardly extending center plate body 49, having a downwardly facing surface 51. Truck assembly 11 has an upper cover plate 52 extending transversely of the truck, and a truck center plate bowl 53 is provided in the center of cover plate 52, with a bearing insert 55 received in the bowl and with the bearing insert having an upwardly facing surface so as to bear against and to mate with the downwardly facing surface 51 of the center plate body 49 thereby to support the weight of the one end of the car on truck assembly 11. As shown in the co-assigned U.S. Pat. No. 3,709,151, so-called side truck bearings 57*a*, 57*b* are provided on either side of the truck center plate bowl 53 so as to support body bolster 35 on opposite sides of truck center plate bowl 53. This construction is substantially conventional, and does not, per se, constitute a part of the present invention. The above-noted co-assigned U.S. Pat. No. 3,709,151 is herein incorporated by reference, and details of the construction of body bolster 35 and of truck assembly 11 may be seen in greater detail by referring to the above-noted U.S. patent. Within the broader aspects of this invention, truck assemblies having a different construction than that discussed above may be employed.

Turning now to a more detailed discussion of end structure 5 of the present invention, the end structure includes a generally triangular shaped tie or gusset plate, as generally indicated at 59, rigidly secured (e.g., welded) to the lower faces of the box beams constituting side sill extensions 31*a*, 31*b*, so that the tie plate forms the lower horizontal web of the side extension box beams. The tie plate also extends axially inwardly toward the mid-portion of the car generally from the intersection of the side sill extensions at the centerline of the car to a point outwardly of the ends of the side sills 27*a*, 27*b*. This tie plate 59 is of relatively heavy construction (e.g., about three-eighths inch in thickness), and the outer edges of the tie plate are generally co-terminal with the outer edges of the side sill extensions. In addition, the vertical spaced flanges 43*a*, 43*b* of the center stub sill assembly 7 are welded to the bottom face of the tie plate so that the tie plate also forms the upper horizontal web of the stub center sill assembly and the upper web of the body bolster 35. Further, the upper edges of the body bolster web 39 are welded to the underface of tie plate 59 so as to rigidly secure both center stub sill assembly 7 and body bolster 35 to end structure 5 of the present invention. Thus, in addition to serving as a gusset between the stub sill, the side sill extension, and the body bolster, tie plate 59 also serves as the horizontal webs of the center stub sill 7, the side sill extensions 31*a*, 31*b*, and the body bolster 35.

End structure 5 also includes a so-called sill strut or tie beam 61 which extends transversely of end slope sheet 15 between the ends of side sills 27*a*, 27*b*. The sill strut beam 61 is rigidly secured (welded) to the outer face of end slope sheet. The sill strut 61 serves to reinforce the lower portion of end slope sheet 15, and is rigidly secured (in a manner as will hereinafter appear) to the ends of side sills 27*a*, 27*b* for positively locating the ends of the side sills relative to one another, and for effectively transmitting compression and tension loads between the ends of the side sills substantially without transferring compression or tension loads between the side sills to the relatively thin end slope sheet 15.

As indicated at 63*a*, 63*b* in FIG. 2, each of the side sheets 13*a*, 13*b* extend somewhat beyond the ends of their respective side sills 27*a*, 27*b*. A so-called transverse end slope sheet support member 65 is welded to end slope sheet 15 above the level of body bolster 35, and to side sheet extensions 63*a*, 63*b* proximate the intersection of the end slope sheet 15 and the side sheets 13*a*, 13*b*. Support beams 67*a*, 67*b* extend downwardly and inwardly from the respective outer ends of transverse end slope sheet support 65 and are secured or welded to the upper face of tie plate 59. Additionally, at the outermost ends of transverse end slope sheet support 65, so-called outer support beams 69*a*, 69*b*, having curved outer faces adapted to mate with the radius of curvature of their respective curved side sheet extensions 63*a*, 63*b*, extend downwardly and are secured to the outermost ends of body bolster 35. As is best shown in FIG. 2, transverse end slope sheet support 65, support beams 67*a*, 67*b*, and outer support beams 69*a*, 69*b*, together with body bolster web 39 are disposed generally in the same transverse vertical plane.

A vertical front end sill plate 71 is affixed to the ends of sill extensions 31*a*, 31*b* and to the end of tie plate 59. As is best shown in FIG. 1, end sill plate 71 is spaced back from the end of center stub sill assembly 7. The ends of side sill extensions 31*a*, 31*b* are shaped so as to abut the transverse end sill plate 71. A pair of vertically disposed tension compression tie members, as indicated a 73*a*, 73*b*, are secured to the upper end of car body 3 and extend inwardly and downwardly from the outer ends of side plates 29*a*, 29*b* to the top of the center stub sill assembly 7, with the lower ends of the tension compression tie members being welded to the outer face of end sill plate 71, and with the upper ends of the tension tie members being welded to the upper end of car body 3. It will be appreciated that tie members 73*a*, 73*b* serve to transmit tension loads from the upper portion of car body 3 to the center sill assembly when overturning moments are applied to car body 3, such as under impact conditions and under squeeze loading. Under draft and coupler uplift loading conditions, members 73*a*, 73*b* are in compression.

As heretofore stated, side sill extensions 31*a*, 31*b* are rigidly secured to the ends of their respective side sills 27*a*, 27*b*. This may, of course, be accomplished by beveling the ends of the side sill extensions 31*a*, 31*b* so that they may be welded around their periphery to their respective side sills. However, a preferred method of joining the diagonal side sill extensions 31*a*, 31*b* to their respective side sills 27*a*, 27*b* and of joining sill strut beam 61 to the ends of the side sills utilizes a connector member, as generally indicated at 75*a*, 75*b*, of suitable material (e.g., cast steel) so as to permit the connector member to be readily fitted into the open ends of the side sills, of the sill extensions, and of the sill strut 61 so as to permit these members to be properly positioned relative to one another and to be held at their desired angles relative to one another, and so as to provide a surface to which the various members may be welded and held in predetermined relation while they are being welded. It will also be understood that through the use of cast, rigid, integral connector members 75*a*, 75*b*, the welds securing the various members to the connector member are separated from one another, and the integral connector member permits uniform load transfer between the various members and their respective welds joining them to the connector member. Also, by the use of rigid connector members 75*a*, 75*b*, less tooling and fixtures are required during fabrication of car end structure 5 of the present invention, thus reducing the labor (and hence the cost) of fabrication of the end structure.

Figure 7:
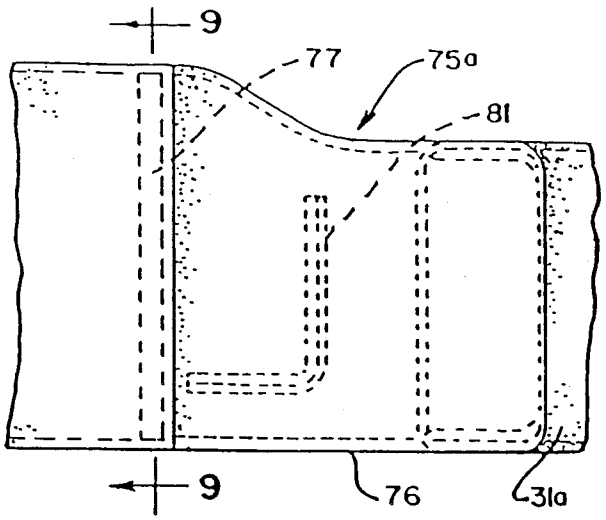
FIG. 7 is an enlarged detail, taken along line 7—7 of FIG. 2, illustrating in enlarged scale the side elevation of the end portion of the end side sill, and further illustrating a unitary casting for joining the side sills and the sill diagonals or extensions, and further for joining a transverse beam or strut extending between the ends of the side sills.
Figure 8:
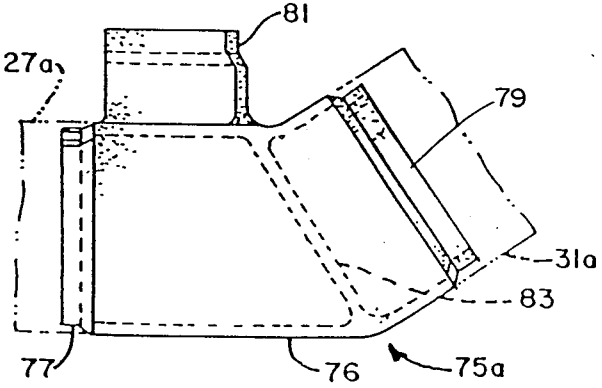
FIG. 8 is a top plan view of the casting shown in FIG. 7 on a somewhat smaller scale.

More specifically, referring to FIGS. 7 and 8, each connector member 75*a*, 75*b* comprises an integral connector body casting 76 of cast steel or the like, having a side sill connector portion 77 adapted to be shaped similar to the inside cross section of a respective side sill 27*a*, 27*b* (as best shown in FIG. 9) so as to have a snug sliding fit within at least a portion of the hollow side sill. It will be understood that the portion of connector body 76 which is necked down so as to constitute side sill connector portion 77 and the end face of the side sill form a generally perpendicular intersection which permits the ready welding of the side sill to the connector body assuring good weld penetration in both the side sill and of the connector body. It will also be appreciated that the thickness of the connector body in the area of the weld zones is preferably about the same thickness as the side sills so as to result in uniform weld strength. Likewise, a sill extension connector portion 79 is provided at the opposite end of connector body 76 so as to fit within the open end of the box beam constituting a respective sill extensions 31*a*, 31*b*. As heretofore explained in regard to side sill connector 77, a good interface between the side sill extensions and the connector body 76 is provided for ensuring optimum welding. Forward of side sill connector 77 and disposed on the inside face of the connector body 76, a sill strut beam connector 81 is provided so as to permit the side strut 61 to be readily welded to connector body 76. A stiffening web 83 is provided internally of body 76 so as to more effectively transmit compression and tension loads, shear loads and moments between the various members secured to the connector body casting. While connector members 75*a*, 75*b* were heretofore described as preferably fitting into the open ends of the side sills and other members, within the broader aspects of this invention, connector members may fit over the outsides of the side sills and other members for alignment and welding purposes. While connector members 75*a*, 75*b* were described as preferably being integral castings, it will be understood that within the broader aspects of this invention that connector members 75*a*, 75*b* may be weldments constructed of a number of steel plates and other parts welded together so as to constitute a unitary connector.

Figure 11:
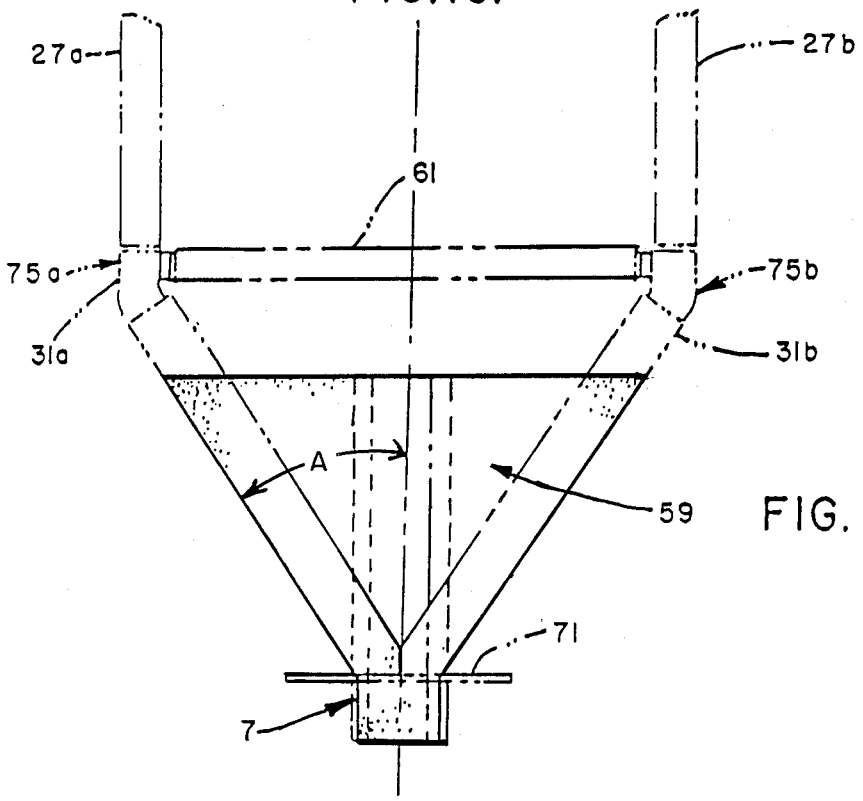
FIG. 11 is a top plan view of a portion of the end structure of the car, showing the center stub sill and a so-called tie plate in solid lines, and showing the end sill diagonals, the side sills, the center stub sill, and the sill strut in phantom, the latter members being above the level of the tie plate, as shown in FIG. 2.

Referring to FIG. 11, it will be noted that tie plate 59 (shown in solid lines) is generally of a V-shape, with the outer margins of the tie plate being generally co-terminal with the outer edges of sill extensions or diagonals 31*a*, 31*b* (shown in phantom). Further, the end of tie plate 59 toward car body 3 is generally co-terminal with the end of center stub sill assembly 7. It will be further noted that the angle between the longtudinal centerline of the car and the centerline of the sill diagonals 31*a*, 31*b* is indicated by A. Within the broader aspects of the present invention, angle A may vary between about 20 and 70 degrees. In the embodiment shown in FIG. 11, angle A is about 30 degrees.

Referring to FIG. 12, a typical center stub sill car is shown having a center stub sill 7' and a pair of spaced side sills 27*a'*, 27*b'* which extend the full length of car body 3' and which extend longitudinally out beyond the ends of the car body. A relatively deep shear plate SP is welded to the inner faces of the side sills and to the center stub sill so as to carry longitudinal loads in transverse direction between the side sills and the center stub sill.

Those skilled in the art will appreciate that the replacement of a shear plate arrangement, such as is shown in FIG. 12, with the diagonal side sill extensions 31*a*, 31*b* of the present invention may be utilized in conjunction with any center stub sill railway car having a center stub sill and a pair of spaced side sills.

In operation and service, it will be appreciated that the car end structure 5 of the present invention results in a car end structure in which the various structural members constituting the end structure primarily carry statically determinate loads such that efficient use of materials in the car end structure can be utilized, thereby permitting the use of the minimum amount of material, and yet ensuring that the car end structure will adequately withstand all anticipated loads with an adequate margin of safety. By utilizing the car end structure 5 of the present invention, it is anticipated that approximately 3,000 pounds (1,362 kg.) will be saved on a typical covered hopper car utilizing the car end construction 5 of the present invention, as compared to a similar conventioal center stub sill car using a shear plate, as shown in FIG. 12. This weight savings represents a significant amount of wight savings allowing additional lading to be carried by the car, and also reducing fuel consumption of a train including cars of the present invention. It is also anticipated that in the event repair of end structure 5 of the present invention becomes necessary, repair of specified structural members will be easier and will require less time than with prior art car end structures.

Referring now to FIGS. 13–22, another embodiment of an end structure, as indicated in its entirety by 5', will now be discussed. Briefly, end structure 5' is generally similar to end structure 5 heretofore described and as illustrated in FIGS. 1–12. It will be understood that parts in end structure 5' having a similar construction and a similar purpose will be identified as "primed" reference characters and a detailed description of these elements and their function will not be provided, but will instead reference may be made to the corresponding parts described in regard to end structure 5.

Succintly stated, end structure 5' includes a center stub sill assembly 7' at each end of the car and side sills 27*a'*, 27*b'* at the sides of the car body 3' at the lower portions thereof which extend lengthwise of the car body with the side sills being connected with the center stub sill by means of diagonal side sill extensions 31*a'*, 31*b'* which are rigidly secured to the ends of their respective side sills into the center stub sill. A body bolster 35' is rigidly secured (welded) to the center stub sill and to the under surface of the side sill extensions 31*a'*, 31*b'* with this body bolster extending transversely of the car to intermediate the longitudinal expanse of the center stub sill 7'. The construction of body bolster 35' is generally to that described hereabove and thus a detailed description of the body bolster may be had by referring to the construction of the previous body bolster 35.

Still further, a truss means (herein referred to as a bolster truss), as generally indicated at 33', is rigidly secured to and extends between in a generally vertical, transverse plane between the center stub sill 7' and the body bolster 35' and the portions of the end of car body 3 thereabove for effectively withstanding and reacting load induced by the lading within car body 35' applied to the ends of the car body and for reacting overturning moments caused by the difference in elevation of center stub sill 7' and the side sills 27*a'*, 27*b'* upon application of trainloads to the coupler (not shown) carried by the center stub sill assembly.

Figure 13:
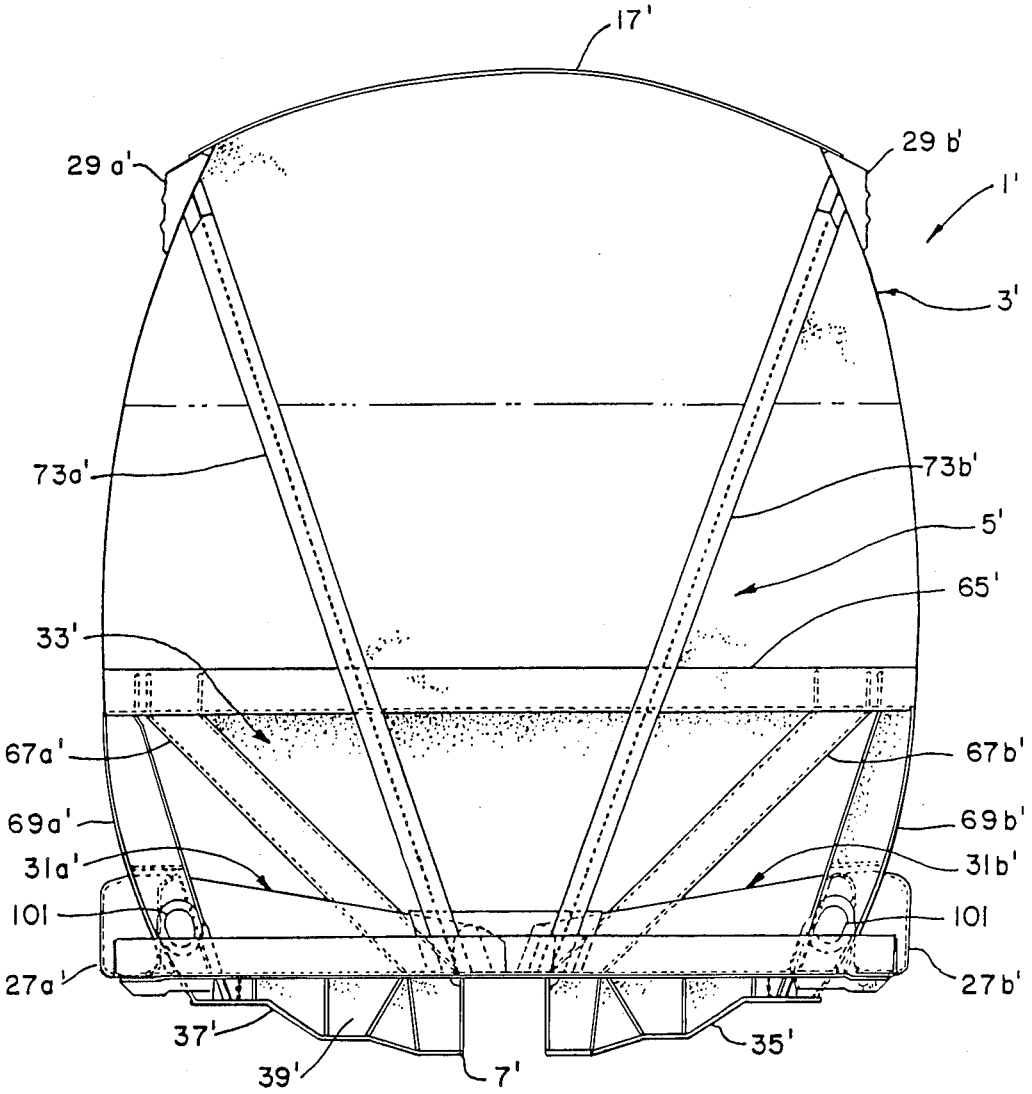
FIG. 13 is an end view of another embodiment of the end structure of this invention in which the sill diagonals or extensions are tapered both heightwise and widthwise and in which a generally vertical extending truss extends between a transversely extending bolster and the end of the car above the bolster with the truss having an upper horizontal transverse member which serves both as a member of the truss and as a support for the end sheet of the car body.
Figure 14:
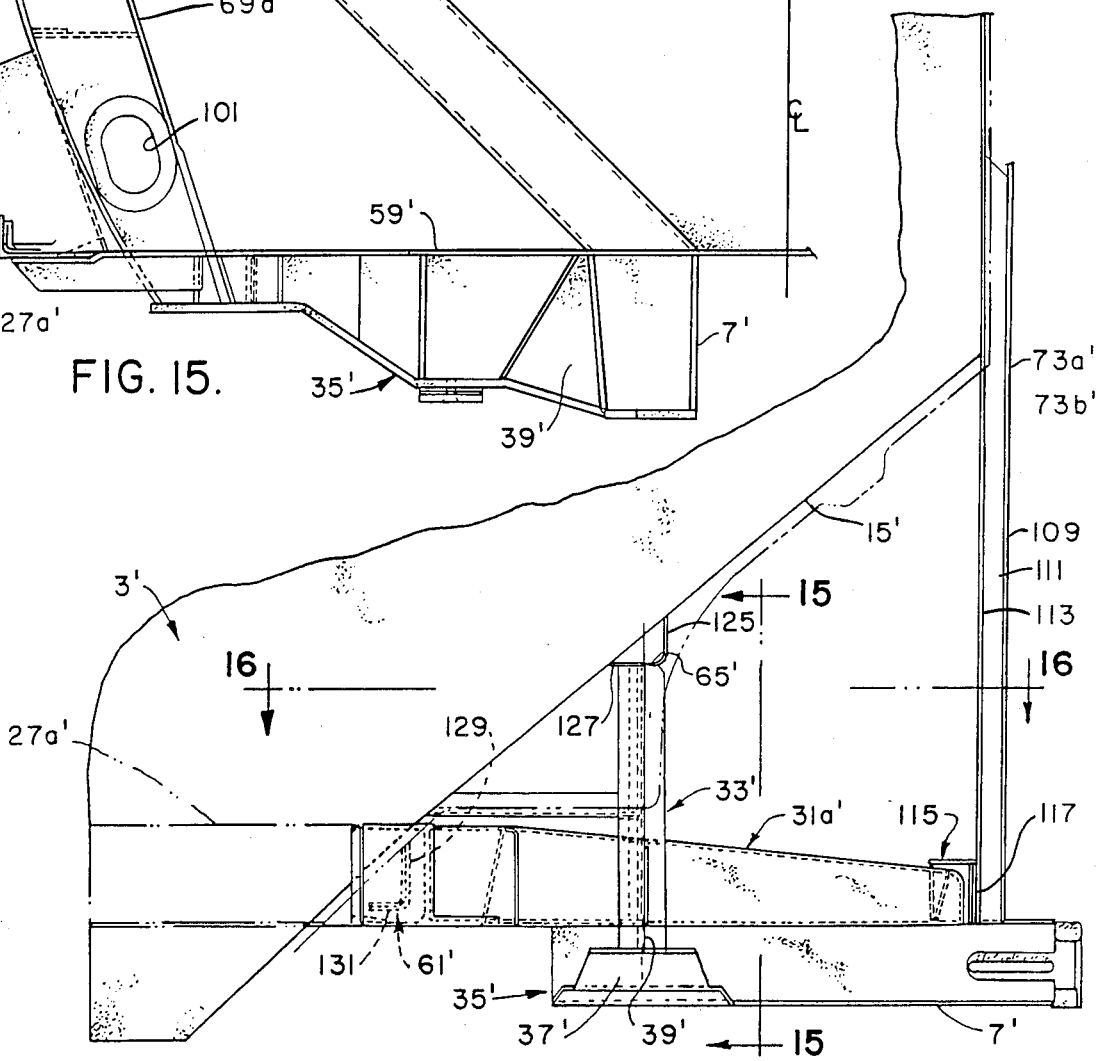
FIG. 14 is a side elevational view of the end structure shown in FIG. 13.
Figures 16, 23:
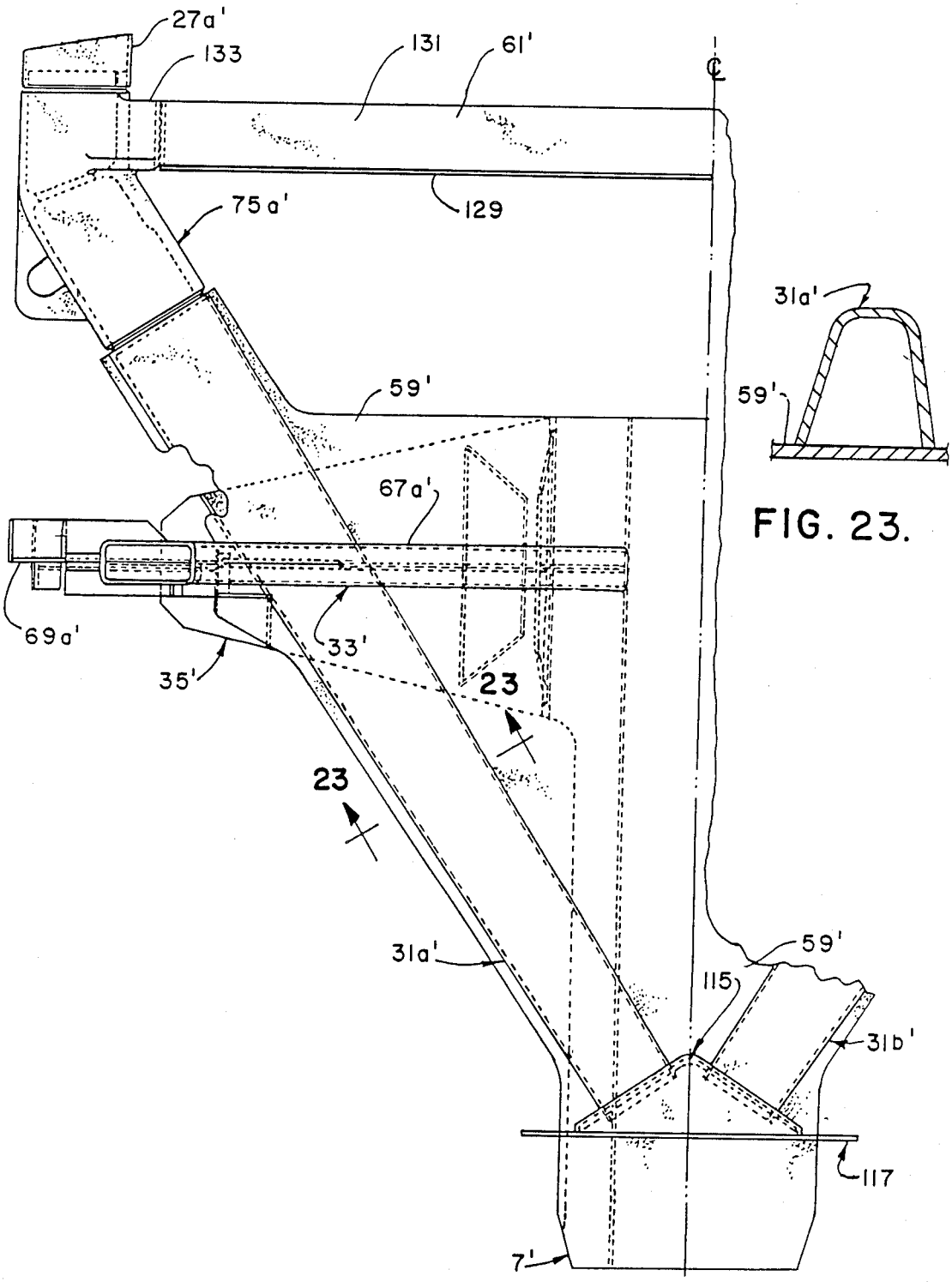
FIG. 16 is a view taken along line 16—16 of FIG. 14 showing one-half of the end structure in top plan and illustrating a structure at the converging ends of the side extensions which facilitates assembly and fabrication of the end structure and the transfer of loads between the side extensions and the center stub sill.
FIG. 23 is a vertical cross sectional of the side sill diagonal extension taken along line 23—23 of FIG. 16.

Specifically, referring to side sill diagonal extensions 31*a'*, 31*b'* as best illustrated in FIGS. 13, 14, and 16, it will be noted that these diagonal side sill extensions are tapered in both heightwise and widthwise direction such that the side sill extensions taper downwardly in height and taper more narrowly in width from the connection of the side sill extensions to their respective side sills 27*a'*, 27*b'* to their outermost ends which are secured to the upper surfaces of center stub sill assembly 7'. In this manner, the side sill diagonal extensions 31*a'*, 31*b'* are tapered in both height and width so as to match the increasing magnitude of the loads carried by the side sill diagonal extensions as such loading is transferred between the ends of the side sill diagonal extensions and the center stub sill assembly 7'.

It will be appreciated that the manner in which the load is transferred between the diagonal side sill extensions 31*a'*, 31*b'* and the center stub sill 7' depends, in some measure, on the length of weld between the side sill extensions 31a', 31b' and the tie plate 59' overlying the top of the center stub sill assembly 7' and forming the top cover plate for both the center stub sill assembly and body bolster assembly 35', in the manner heretofore described in regard to end structure 5 heretofore described. Additionally, it will be appreciated that since the diagonal side sill extensions 31a', 31b' support the weight of car body 3' on center stub sill assembly 7', the bending moment applied to the diagonal sill extensions 31a', 31b' progressively increases from the outer end of the car toward the juncture of the side sill diagonal extensions and their respective side sills 27a', 27b'. Further, as best illustrated in FIG. 23, each of the diagonal side sill extensions 31a', 31b' is preferably (but not necessarily) wider at its bottom than at its top such that the centroid of the section of the diagonal side sill extension is low (i.e. less than half of the height of the section) so that it is more in concert with the source of the load input. It will be understood that the primary source of the longitudinal load input of the side diagonals is along the bottom edges thereof which are welded to the upper face of the tie plate 59'. Further, this flared shape of the side sill diagonal members 31a', 31b' as illustrated in FIG. 23, facilitates manufacture of end structure 5' These features of the side sill diagonals 31a', 31b' result in a structure which realizes a meaningful savings in weight over the previous end structure 3, and yet which still has sufficient strength to withstand all loading conditions to be experienced by railway car 1'.

Further in accordance with this invention, it will be particularly noted that the outer vertical member 69a', 69b' of truss 33' are each provided with a reinforced cable hook hole 101. It will be appreciated that the Association of American Railroads (AAR) design specification require that a means be provided so as to permit the vertical lifting of the car body with a cable/-hook arrangement. These AAR specifications further require that cable lift arrangement be located near the ends of the car. By incorporating a reinforced cable hook hole 101 in each of the outermost vertical bolster truss members 69a', 69b', these outermost bolster truss members are able to provide the double function of both being a member of the bolster truss assembly 33' and also being the required structure so as to permit the car to be vertically lifted by a cable arrangement, as required by AAR design specifications. It will be appreciated that by truss members 69a', 69b' serving this double function, the AAR design specifications can be met without the requirement of additional structure and increased weight of the end structure.

Figures 17, 18, 19, 20, 21, 22:
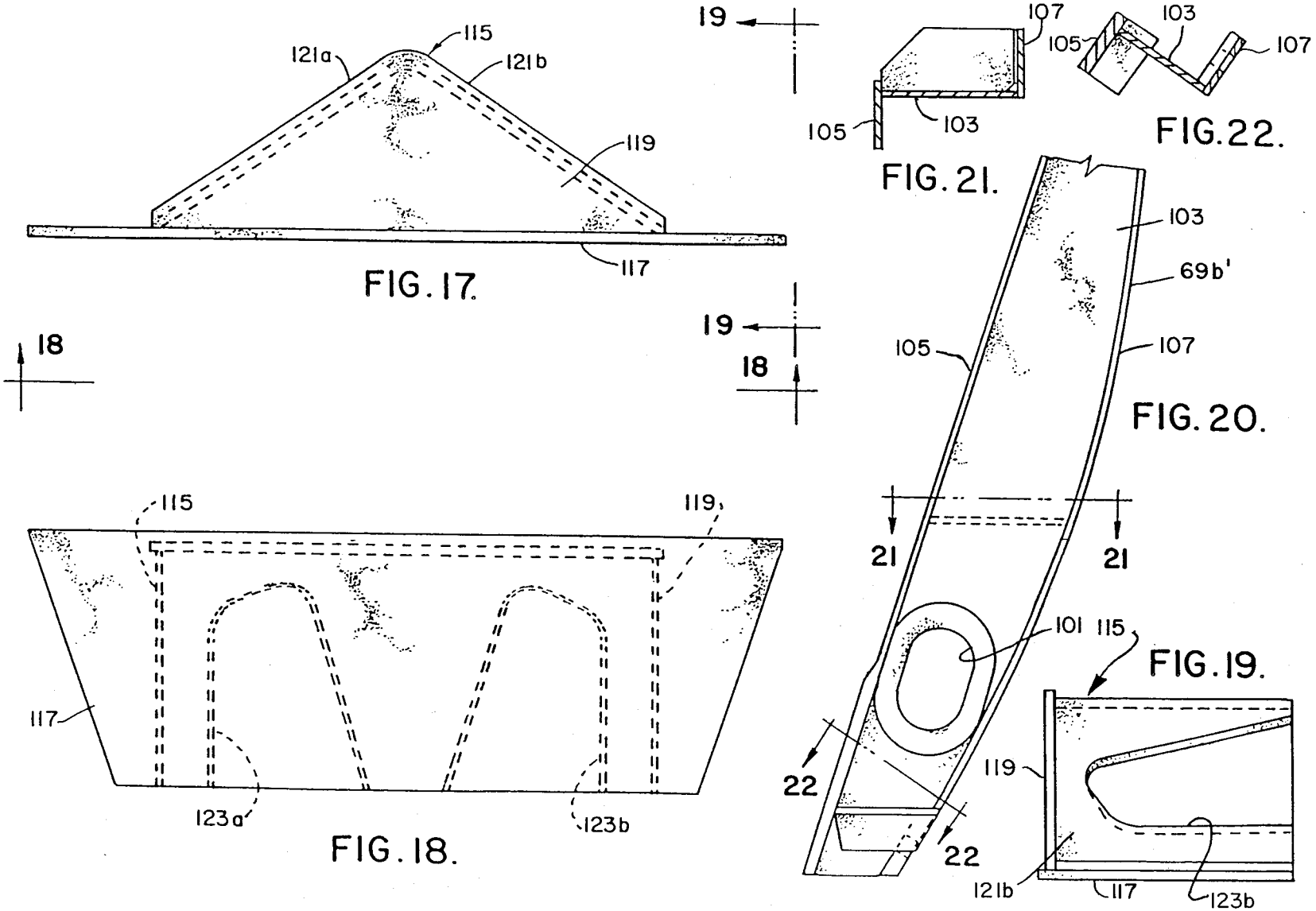
FIG. 17 is an enlarged view taken along line 17—17 of FIG. 16 illustrating a top plan view of a housing secured (welded) to the center stub sill and having openings for the slip-fit reception of the ends of the side extensions thus to accommodate dimensional variations and to facilitate welding of the ends of the side extensions.
FIG. 18 is an outer end elevational view of the housing taken along line 18—18 of FIG. 17.
FIG. 19 is a side elevational view of the housing of FIG. 17 taken along line 19—19 of FIG. 17.
FIG. 20 is an enlarged front elevational view of an outermost vertical member of the bolster truss which has a curved outer flange so as to blend with the curved side walls of the rail car body.
FIGS. 21 and 22 are cross-sectional views taken along lines 21—21 and 22—22, respectively, of FIG. 20 illustrating the construction of this outer bolster truss member.

Still further in accordance with this invention, it will be noted that the shape of the various members constituting vertical truss assembly 33' facilitates welding of the truss members in place, and further facilitates the load transmission between the various elements of end structure of 5' of railway car 1' which these truss members interconnect. More specifically, it will be noted that, as best shown in FIGS. 20 22, the outer upper bolster vertical truss members 69a', 69b' is generally of an I-beam construction shape having a web 103, an inner flange 105 and an outer flange 107. As best illustrated in FIG. 20, the outer flange 107 is curved so as to match the curvature of the side sheets 13a', 13b' of car body 3'. Also, with the cross section of the outer bolster truss members 69a', 69b' being generally I' or Z' shaped, as shown in FIGS. 21 and 22, and with the outer flange 107 being curved, as above noted, these truss members are so configured so as to allow for the optimum transfer of load between end sheets 13a', 13b' of the car and body bolster assembly 35'.

Figure 15:
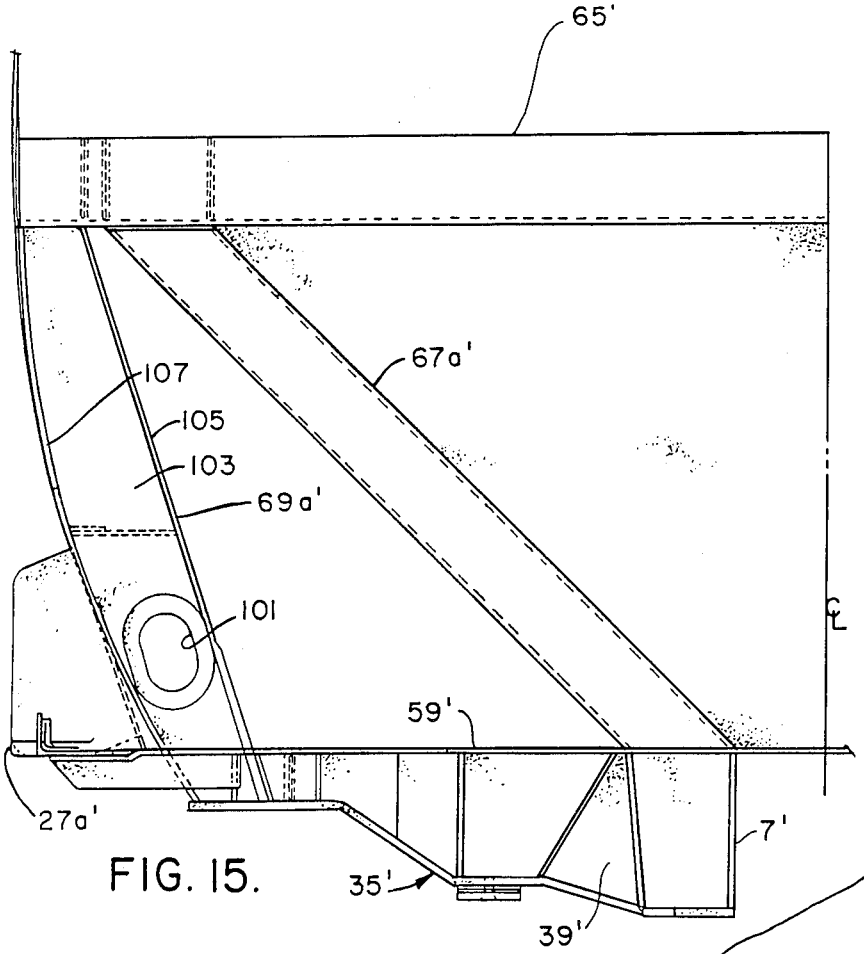
FIG. 15 is an enlarged cross-sectional view taken along line 15—15 of FIG. 14 illustrating one half (i.e., the left hand half) of the truss shown in FIG. 13 (with the side sill extension omitted for clarity), and particularly illustrating the configuration of the bolster, the outer bolster truss members extending between the outermost portions of the bolster and a respective outer end upper horizontal transverse member of the truss, and still further illustrating the shape of the members of the truss which facilitates fabrication of the truss and which increases the load-carrying capability of the truss.

In addition, the inner upper bolster truss members 67a', 67b', as best shown in FIGS. 13, 15, and 16, are shown to be rectangular box section tubes so as permit the easy attachment or weldment of these upper bolster truss members to tie plate 59' and to the upper horizontal truss member 65'. Still further, it will be noted that the tension/compression tie members 73a', 73b' are generally H - shaped beam members having an outer vertical flange 109, an inner vertical flange 111 and a web 113 interconnecting the inner and outer flanges. In this manner, the tension/compression tie members 73a', 73b' are so configured as to optimally resist buckling when subjected to compression loading and yet present a flat surface for easy attachment of the upper ends of the tie members to the generally vertical portions for the end sheet for the car body, as best shown in FIG. 14.

Referring now to FIGS. 16–19, in accordance with this invention, means, a housing, as generally indicated at 115, is provided to facilitate reception of the outer ends of side sill extensions 31a', 31b', to permit the ready securement (welding) of the ends of the side sill extensions to the center stub sill 7', and to readily accommodate dimensional variations. This housing 115 includes a vertical end plate 117 which extends transversely across the upper surfaces of center stub sill assembly 7' somewhat outboard of the ends of side sill diagonals 31a', 31b'. Housing 115 and end plate 117 are rigidly secured (or welded) to the upper face of tie plate 59'. On the inside face of plate 117 toward the end sheet 15' of car body 3', a connector housing 119 is secured. This connector housing is of generally triangular shape and has a pair of faces 121a, 121b with respective openings 123a, 123b therein for receiving the outermost ends of respective side sill extensions 31a', 31b' in slip-fit fashion. It will be noted that the configuration openings 123a, 123b is generally similar to the profile of the outer ends of the side sill diagonals 31a', 31b. It will also be noted that the openings 123a, 123b are open on the bottoms. In this manner, with the side sill diagonals 31a', 31b' in place on the upper surface of tie plate 59; housing 119 may be fitted down over the outer ends of the side sill diagonals 31a', 31b' in a slip-fit fashion and thus may readily accommodate variations in length and dimensional tolerances between the side sill diagonals and the center stub sill 7' which heretofore have proved to represent a considerable fit and welding problem during fabrication of the end structure of the present invention. Additionally, the size of openings 123a, 123b relative to the outer end portions of the side sill diagonals 31a', 31b' is such that a good fit up exists between housing 119 and the ends of the side sill diagonals thereby to present substantially butting surfaces adjacent the outer surfaces of the side sill diagonals such that it is easy to weld around the entire periphery of the ends of the side sill extensions thereby to securely join the ends of the side sill extensions to housing 119. As shown best in FIG. 14, flange 113 of the tension/compression tie members 73a', 73b' abuts against the outer face of plate 117 and thus may be readily welded thereto.

Still further in accordance with this invention, it will be noted that the upper bolster truss transverse member 65' is generally an angle shaped member (as best shown in FIG. 14) having a vertical leg 125 and a horizontal leg 127 with the outer edges of these legs secured (welded) to the outer face of end sheet 15'. Further, this upper bolster truss transverse member 65' is welded in position on end sheet 15' substantially directly above the center plate 39' of body bolster 35'. In this manner, the upper ends of inner bolster truss members 67a', 67b' and outer bolster truss members 69a', 69b' may be welded to the bottom horizontal face of leg 127 of horizontal truss member 65'. It will also be understood that, in accordance with this invention, the upper bolster truss transfers member 65' serves double duty in that it not only serves as an attachment to the end of car body 3' for the upper portions of truss 33', but it also serves as a reinforcement for end sheet 15' of the car body such that no other reinforcements are required to support end sheet 15' for reacting both vertical and longitudnal loads from the lading within car body 3' against end sheet 15'.

Likewise, sill strut 61' extending transversely between connector castings 75a', 75b' at the juncture of side sills 27a', 27b' and their respective side sill diagonal or extension members 31a', 31b' is also an angle shaped member having a vertical flange 129 and a horizontal flange 131 so dimensioned that the outer edges thereof butt against the outer face of end sheet 15' so that they may be substantially continously welded thereto transversely of the railcar. In this manner, the sill strut 61' serves the double function to both reinforce the lower portion of end sheet 15' and to react or transmit tension and compression loads between the ends of side sills 27a', 27b' substantially without transferring these compression loads to the relatively thin end slope sheet 15'. Connector castings 75a', 75b' each have an inwardly extending angle shaped connector lug 133 (see FIG. 16) which is adapted to fit with and interconnect the angle-shaped side sill strut 61' thereby to facilitate connection of sill strut 61' to the connector castings.

Figure 24:
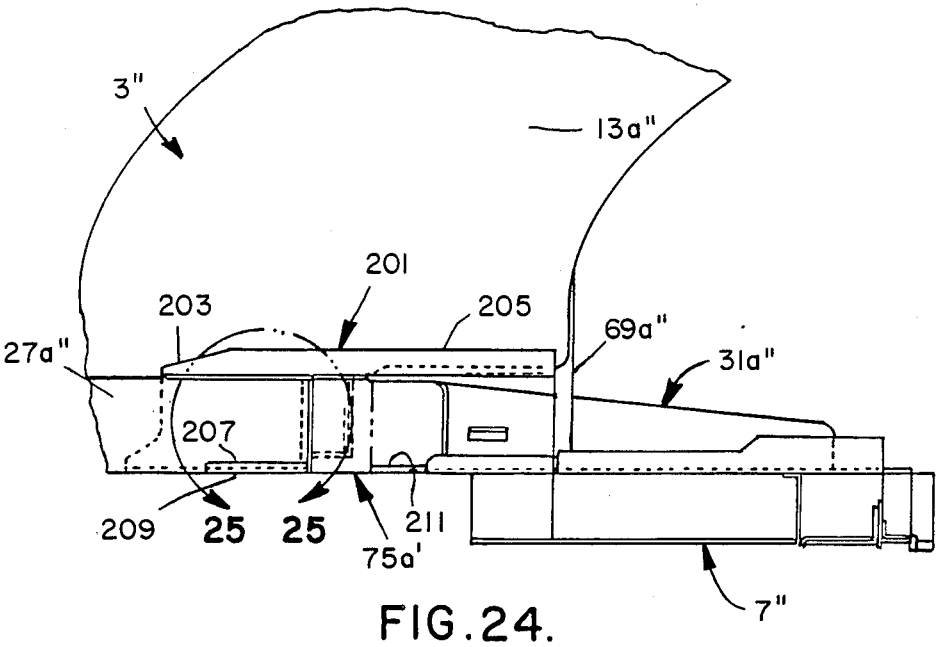
FIG. 24 is a view similar to FIG. 14 showing, in side elevation, a connector casting interconnecting a side sills and its respective side sill diagonal extension and further showing a roping staple in the casting, a transition plate for transmitting loads between the side sill and side sheet adjacent the casting, and a cutout plate in the side sill adjacent the casting facilitating the internal welding of the casting to the side sill and side sheet.
Figure 25:
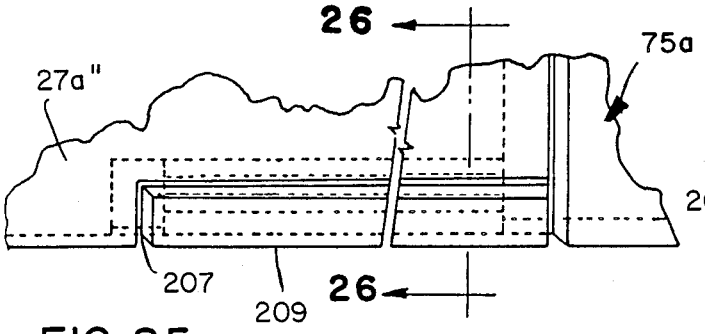
FIG. 25 is an enlarged scale view of a portion of the side sill and connector casting taken on line 25—25 of FIG. 24.
Figure 26:
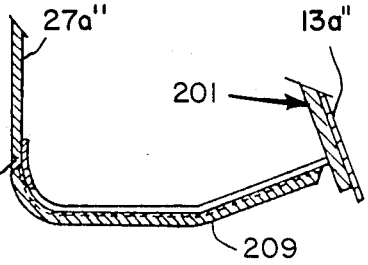
FIG. 26 is a cross sectional view taken along line 26—26 of FIG. 25.
Figure 29:
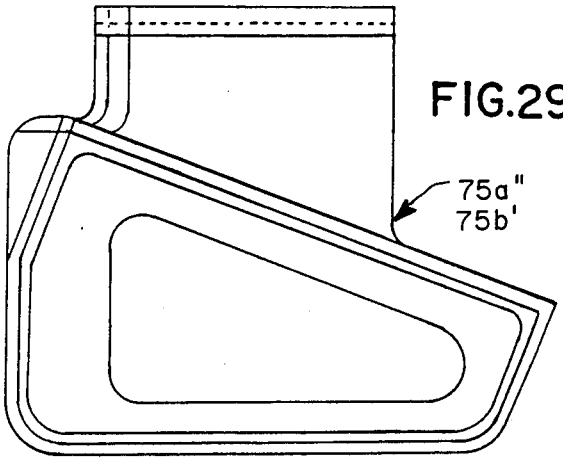
FIG. 29 is an end view taken along line 29—29 of FIG. 27; and 0 is an end view taken along line 30—30 of FIG. 27.
Figure 30:
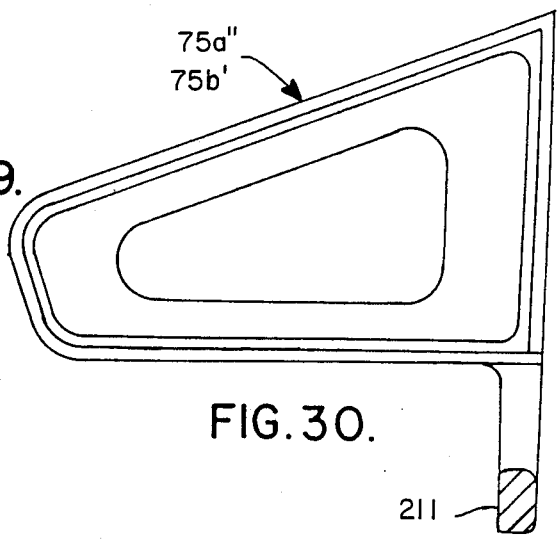
Figure 27:
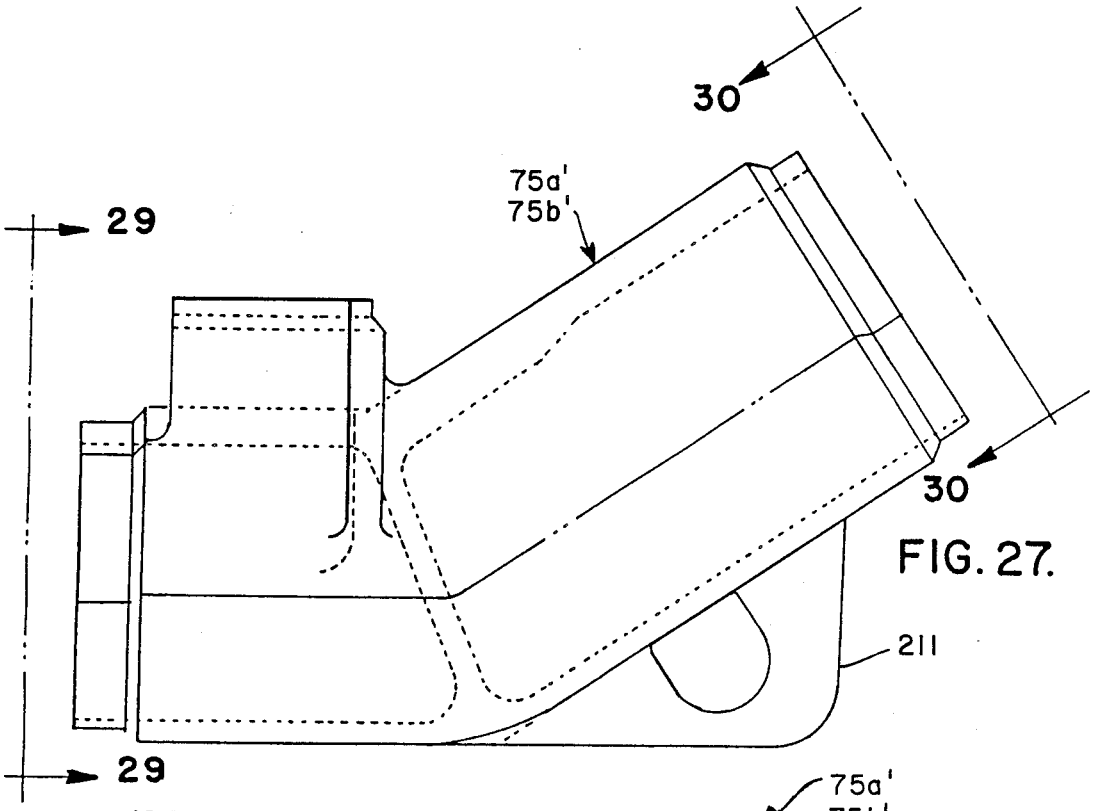
FIG. 27 is a top plan view of the connector casting illustrating the integral roping staple.
Figure 28:
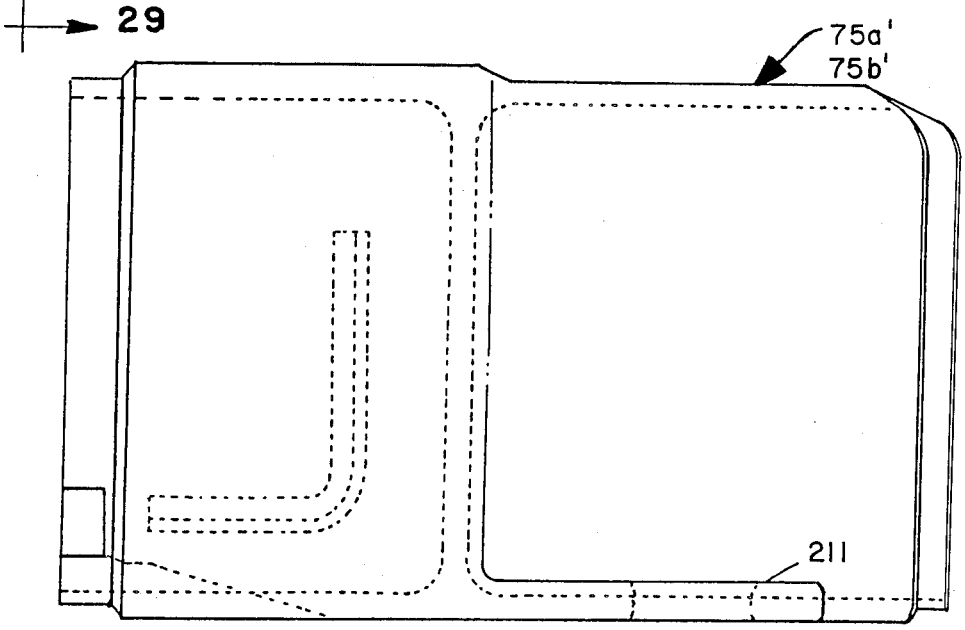
FIG. 28 is a front side elevational view of FIG. 27.

Referring now to FIGS. 24–26, a transition plate, as generally indicated to 201, is secured (welded) to each end of end sheet 13a'' and to the outer end of each side sill 27a'' so as to facilitate the transfer of loads of the end structure 5 between the side sheet and the side sill at the connection of the side sill to its respective side sill diagonal extension 31a'. Transition plate 201 is formed to the curvature of the outer surface of side sheets 13a', 13b'' and is welded around its periphery to its respective side sheet. The inboard end (i.e., its lefthand end, as shown in FIG. 24) is tapered, as indicated at 203, so as to gradually blend the transfer of loads between the side sheet and side sill. In addition to transition plate 201 facilitating the transfer of load, the transition plates locally reinforce the side sheets so as to lessen the tendency of the relatively thin side sheets to buckle.

Further referring to FIGS. 24–26, it will be seen that a cutout, as indicated at 207, is provided in the bottom of side sills 27a', 27b'' at the outer ends thereof. This cutout 207 is a blind notch which is of sufficient size so as to provide access to the interior of the side sill and to the connector castings 25a', 75b'. This access permits inside wells to be made between the side sill and the side sheet, and between the side sill and the connector casting.

After such interior welds has been made, a cover 209, preferably of high strength weldable steel, is fitted on to the portions of side sill 27a', 27b'' defining opening 207, and the cover is welded to the side sill and the connector casting. In FIGS. 25 and 26, the welds securing plate 209 in place are not shown. It will be appreciated that the lower portions of the side sills 27a'27b' at outer ends thereof are local high load areas. Inboard of cutout 207, these locally high loads become more uniformily distributed in the side sill. By providing covers 209 of high strength steel, the covers are able to readily withstand these locally high loads without additonal reinforcement of the side sills. This results in a weight savings for the car as well as facilitates assembly and welding.

Referring now to FIGS. 24 and 27–30, a connector casting 75a', 75b' is shown in greater detail. In comparing connector casting 75a', 75b' to connector casting 75a, 75b as shown in FIGS. 7 and 8, it will be noted that connector casting 75a', 75b, has a roping staple or eye 211 intergrally cast-in-place with the casting. This roping staple 211 is disposed on the outer face of the casting leg which receives and which secures the inboard end of side sill diagonal 31a'', 31b'' to the connector casting. It will be appreciated that the specifications of the Association of American Railroads (AAR) requires that a roping staple be provided on the ends of a rail car such that a hook and cable may be readily attached to the car for towing the car along the track. With roping staple 211 integrally cast-in-place on connector casting 75a'', 75b'', this AAR specification can readily be met without the requirement of any additional structure for supporting a roping staple.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

We claim:

1. In an end structure for a railway car, said railway car having a car body, the latter having side sheets, said end structure comprising a center stub still located generally along the longitudinal centerline of the railway car, a side sill at each side of the car extending longitudinally thereof along both sides of the car body in spaced transverse relation to center stub sill for carrying longitudinal loads from one end of the car to the other, and a side sill extension extending diagonally between an end of a respective said side sill and said center stub sill for carrying substantially all of the horizontal, longitudinal loads between said side sill and said center sub sill, wherein the improvement comprises: a connector casting between the outer end of the side sill and the inner end of the side sill extension, each of said side sills having a cutout in the lower portion thereof adjacent the outer ends of the side sill, said cutout being of sufficient size so as to facilitate welding of the inner surfaces of the side sills to the side sheets and of the side sill to said connector casting.

2. In an end structure as set forth in claim 1 further comprising a cover plate covering said cutout, said cover plate being welded to said side sill adjacent the portions thereof defining said cutout.

3. In an end structure as set forth in claim 2 wherein said cover plate is of a high strength, weldable material.

4. In an end structure for a railway car, said end structure comprising a center stub sill located generally along the longitudinal centerline of the railway car, a side sill at each side of the car extending longitudinally thereof along both sides of the car body in spaced transverse relation to center stub sill for carrying longitudinal loads from one end of the car to the other, and a side sill extension extending diagonally between an end of a respective said side sill and said center stub sill for carrying substantially all of the horizontal, longitudinal loads between said side sill and said center stub sill, said car having a side sheet at each side of the car extending upwardly from side sills, wherein the improvement comprises: a transition plate secured to said side sheet and to said side sill adjacent the end of the latter for transferring loads between said side sheet and said side sill and for resisting buckling of said side sheet adjacent the ends of its respective said side sill wherein an inboard end of said transition plate is tapered downwardly to said side sill for gradually transferring loads between said side sill and the inboard end of said transition plate.

5. In an end structure for a railway car, said end structure comprising a center stub sill located generally along the longitudinal centerline of the railway car, a side sill at each side of the car extending longitudinally thereof along both sides of the car body in spaced transverse relation to center stub sill for carrying longitudinal loads from one end of the car to the other, and a side sill extension extending diagonally between an end of a respective said side sill and said center stub sill for carrying substantially all of the horizontal, longitudinal loads between said side sill and said center stub sill, wherein the improvement comprises: a connector casting secured between said side sill and a respective said said sill extension, said casting having a roping staple integrally cast therewith for reception of a cable hook to facilitate pulling of said rail car along the track.

* * * * *